US005081782A

United States Patent [19]

Wright

[11] Patent Number: 5,081,782

[45] Date of Patent: Jan. 21, 1992

[54] GUN STAND

[76] Inventor: Lloyd A. Wright, 4636 Robindale Rd., Knoxville, Tenn. 37921

[21] Appl. No.: 569,842

[22] Filed: Aug. 20, 1990

[51] Int. Cl.[5] ..... F41A 23/04; F41A 23/52

[52] U.S. Cl. ..... 42/94

[58] Field of Search ..... 42/94; 89/37.04; 248/146, 158, 161, 162.1, 519

[56] References Cited

U.S. PATENT DOCUMENTS

| | | | |
|---|---|---|---|
| 879,052 | 2/1908 | Jeranek | 42/94 |
| 1,112,732 | 10/1914 | Uhl | 42/94 |
| 2,729,975 | 1/1956 | Hawthorne et al. | 89/37.04 |
| 2,731,829 | 1/1956 | Wigington et al. | 89/37.04 |
| 3,225,656 | 12/1965 | Flaherty et al. | 42/94 |
| 4,819,359 | 4/1989 | Bassett | 42/94 |
| 4,841,839 | 6/1989 | Stuart | 89/37.04 |

*Primary Examiner*—Charles T. Jordan
*Attorney, Agent, or Firm*—Pitts and Brittian

[57] ABSTRACT

An improved gun stand to be used for securing a gun and that is capable of absorbing recoil that results from firing said gun. The stand is constructed with a stabilizing base and a readily adjustable recoil absorbing inertial mass incorporated into the base. The base receives an elongated support member which may have allow for adjusting the length or height of the stand. The stand clamps or grips and secures the gun while the gun is being fired or cleaned.

21 Claims, 3 Drawing Sheets

GUN STAND

TECHNICAL FIELD

This invention relates to a stand used to hold a gun, whether rifle, shotgun or pistol, while the gun is being fired, cleaned or repaired.

BACKGROUND ART

Gun enthusiasts, whether rifle, shotgun or pistol shooters, often find it necessary to immobilize a gun in order to adjust or "zero in" the gun sight, be it a blade sight or a telescopic sight. It will be of course understood that the term "gun" as used herein includes but is not limited to a rifle, shotgun or a pistol. The gun stand must be able to withstand or absorb the recoil of the gun. Recoil absorbing gun stands are well known in the art. Prior art stands have taken a "one size fits all" approach to the problem of developing a stand with sufficient mass to absorb the recoil of today's magnum powered big game rifles. For the enthusiast that prefers target shooting or small game hunting with a lighter, smaller caliber gun, this much mass in a stand is unnecessary and undesired. For the enthusiast that shops by mail, much of the expense is generated by the shipping weight of the stand. What is missing from the prior art is a stand that incorporates an easily adjustable inertial mass that absorbs a gun's recoil. This type of stand would accommodate shooters of various caliber guns by providing a stand with a choice of recoil absorbing inertial masses. For the shooter that enjoys a variety of calibers, for instance a shooter that target shoots with a 0.22 caliber target rifle and hunts with a 7 mm magnum big game rifle, the stand's inertial mass is readily changeable so that the shooter is not burdened with unnecessary weight.

Accordingly, it is an object of this invention to provide an improved gun stand with a readily changeable recoil absorbing inertial mass.

Another object of this invention is to provide an improved gun stand with a readily changeable recoil absorbing inertial mass that also functions as a supportive base.

A further object of this invention is to provide a stand that allows the height of the stand to be readily adjusted.

Still another object of this invention is to provide a stand that has gripping means that grip the stock of the gun that is to be fired or cleaned.

Other objects and advantages over the prior art will become apparent to those skilled in the art upon reading the detailed description together with the drawings as described as follows.

DISCLOSURE OF THE INVENTION

In accordance with the various features of this invention, an improved gun stand constructed in accordance with various features of the present invention is provided which comprises a stabilizing base and a readily adjustable recoil absorbing inertial mass incorporated into the base. The base receives an elongated support means which may have means for adjusting the length or height of the elongated support means. A clamping or gripping means is attached to the upper end of the elongated support means. This clamping means secures the gun while the gun is being fired or cleaned.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
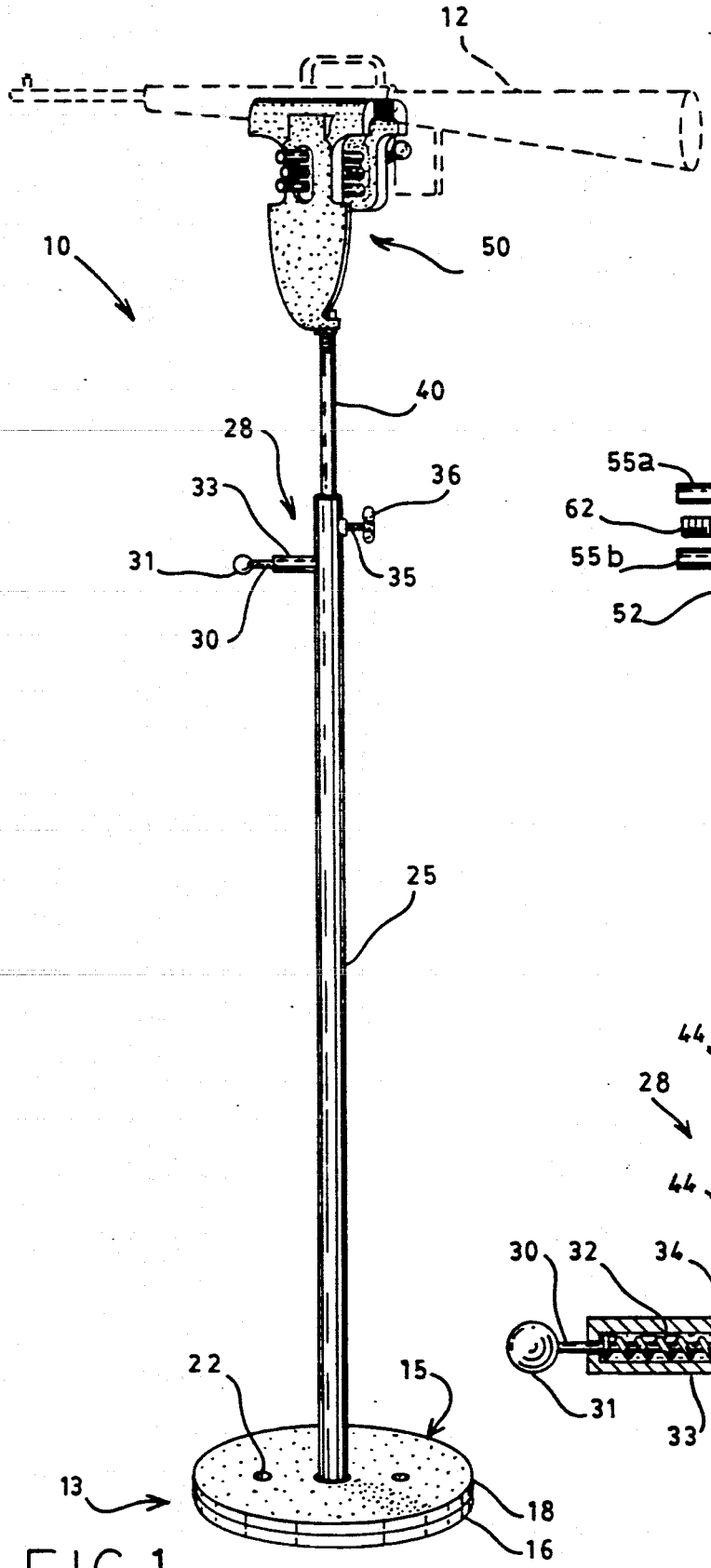
FIG. 1 illustrates a perspective view of an improved gun stand constructed in accordance with the various features of the present invention in use with a gun shown in phantom.

An improved gun stand constructed in accordance with various features of the present invention is illustrated generally as 10 in FIG. 1. The stand 10 comprises a base 13 which engages a supportive surface such as the ground or a floor. The stand 10 further comprises an inertial mass means 15. In the illustrated preferred embodiment the inertial mass means 15 also functions as the base 13 thereby alleviating the need to attach or otherwise anchor the base 13 to the supportive surface.

Figure 3:
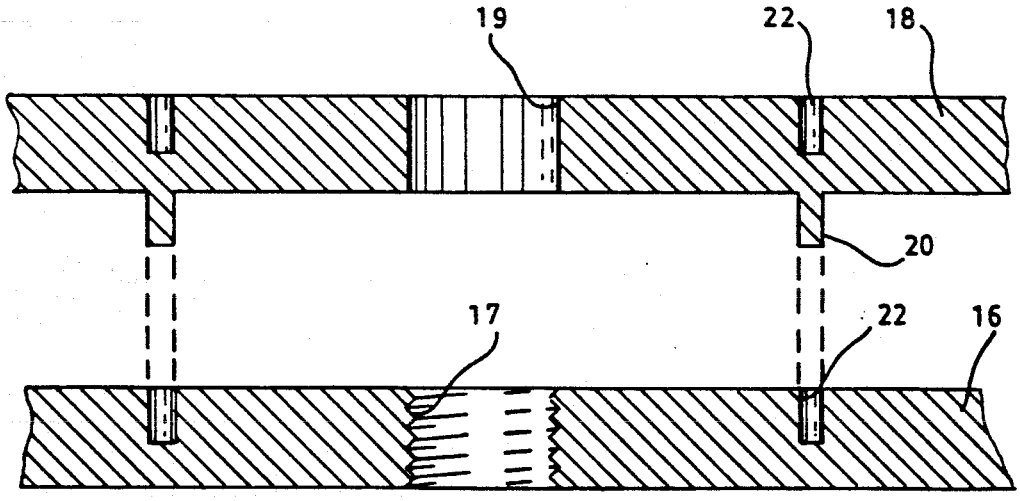
FIG. 3 illustrates a partial vertical cross sectional view of the readily adjustable recoil absorbing inertial mass of the device illustrated in FIG. 1 with the multiple sections thereof separated.

The inertial mass means 15 serves to absorb the recoil of the gun being fired. The inertial mass means 15 is composed of a plurality of inertial mass members 16 and 18. This preferred configuration allows the inertial mass means 15 to be readily adjustable depending on the needs of the shooter. While only two inertial mass members 16 and 18 have been illustrated, it will be understood that, depending on the needs of the shooter, the invention is capable of use with only the lower inertial mass member 16 or with additional inertial mass members such as 18 stacked in cooperation with lower inertial mass member 16. In the preferred embodiment additional inertial mass member 18 and lower inertial mass member 16 are releasably interlocked by male members 20 (see FIG. 3) which are carried by the lowermost surface of additional inertial mass member 18 and which are received by cooperating female receptors 22 which are carried by the uppermost surface of lower inertial mass member 16 and additional inertial mass members 18. It will be understood, of course, that male members 20 could be carried by the uppermost surface of lower inertial mass member 16 and additional inertial mass members 18 and cooperating female receptors 22 could be carried by the lowermost surface of additional inertial mass member 18. As an alternate embodiment (see FIG. 6), additional inertial mass member 18' could be threadably received by lower inertial mass member 16'. A threaded receptor 17' is provided in the upper surface of inertial mass members 16' and 18' and a threaded extension 21, which is in register with threaded receptor 17', is carried by the lower surface of additional inertial mass member 18'. The lower end of upright member 25 is received by threaded receptor 17' in the uppermost inertial mass member 18'.

Referring again to FIG. 1, the base 13 receives an upriqht member 25; in the preferred illustrated embodiment, upright member 25 is threadably received by a threaded female member 17 carried by lower inertial mass member 16. In the preferred embodiment, upright member 25 carries height adjusting means 28.

In one preferred embodiment, upright member 25 and a telescoping shaft 40 telescope together thus providing for height adjustability. It will of course be understood that the stand of the present invention could be constructed with an upright member of a selected height to suit a given shooter thus eliminating the need for height adjustability and thus eliminating the need for shaft 40. In the illustrated preferred embodiment, shaft 40 is received within upright member 25. It is contemplated, of course, that upright member 25 could be received within shaft 40. Shaft 40 can be releasably locked at a selected height by height adjusting means 28.

Figure 4:
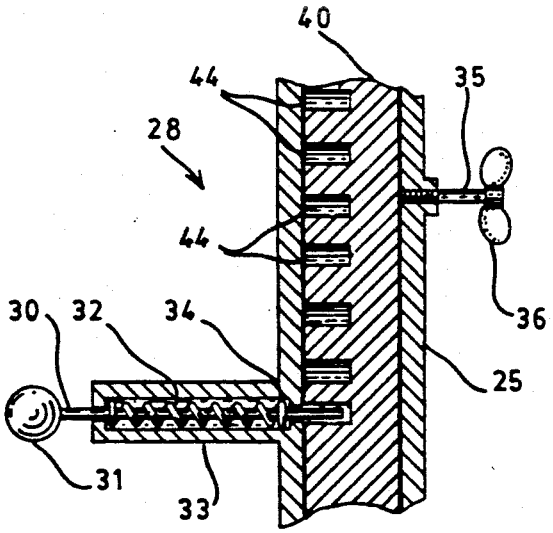
FIG. 4 illustrates a partial vertical cross sectional view of the height adjusting means of the device illustrated in FIG. 1.
Figure 2:
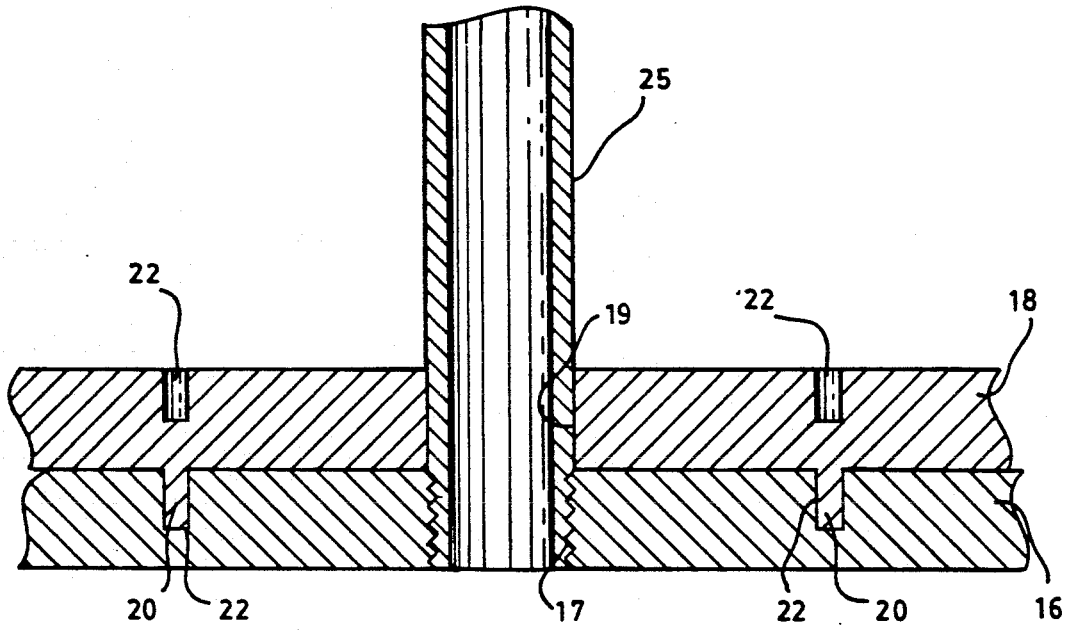
FIG. 2 illustrates a partial a vertical cross sectional view of the base of the device illustrated in FIG. 1.

Referring to FIG. 4, height adjusting means 28 is comprised of a plurality of receptors 44 carried by shaft 40. It is of course understood that if stand 10 is constructed such that upright member 25 is received within shaft 40, receptors 44 will be carried by upright member 25. Hole defining member 44 receives a height adjusting rod 30 which is received in spring housing 33. Height adjusting rod 30 is held in cooperation with receptor 44 by spring 32 which applies a spring force against spring stop 34 which is carried by height adjusting rod 30. The spatial relationship between height adjusting rod 30 and receptor 44 results in a small amount of play between telescoping shaft 40 and upright member 25. This excess play can be prevented by turning knob 36 this tightens a fine tuning stop 35 which is threadably received by upright member 25 such that fine tuning stop 35 creates a frictional fit against telescoping shaft 40 when twisted thus preventing movement of telescoping shaft 40 relative to upright member 25.

Figure 5:
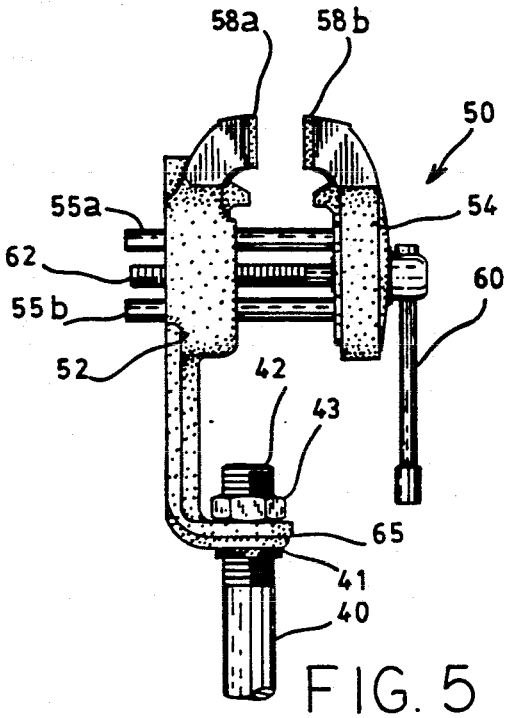
FIG. 5 illustrates an elevational view of the gun clamping means of the device illustrated in FIG. 1.

In the illustrated preferred embodiment, a gripping means 50 is received by the upper portion of telescoping shaft 40. According to the needs of the shooter, gripping means 50 can either be releasably received by or permanently received by telescoping shaft 40. In the preferred illustrated embodiment, as shown in FIG. 5, shaft receiving member 65 receives a threaded end 42 of telescoping shaft 40 and is sandwiched between threaded stop member 41 and threaded nut 43.

Figure 6:
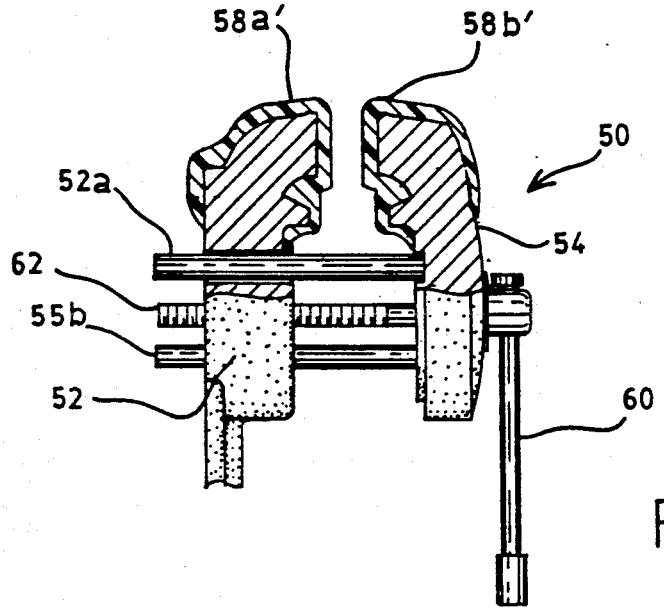
FIG. 6 illustrates a partial cross-sectional view of an alternate embodiment of the gun clamping means of the device illustrated in FIG. 1.
Figure 7:
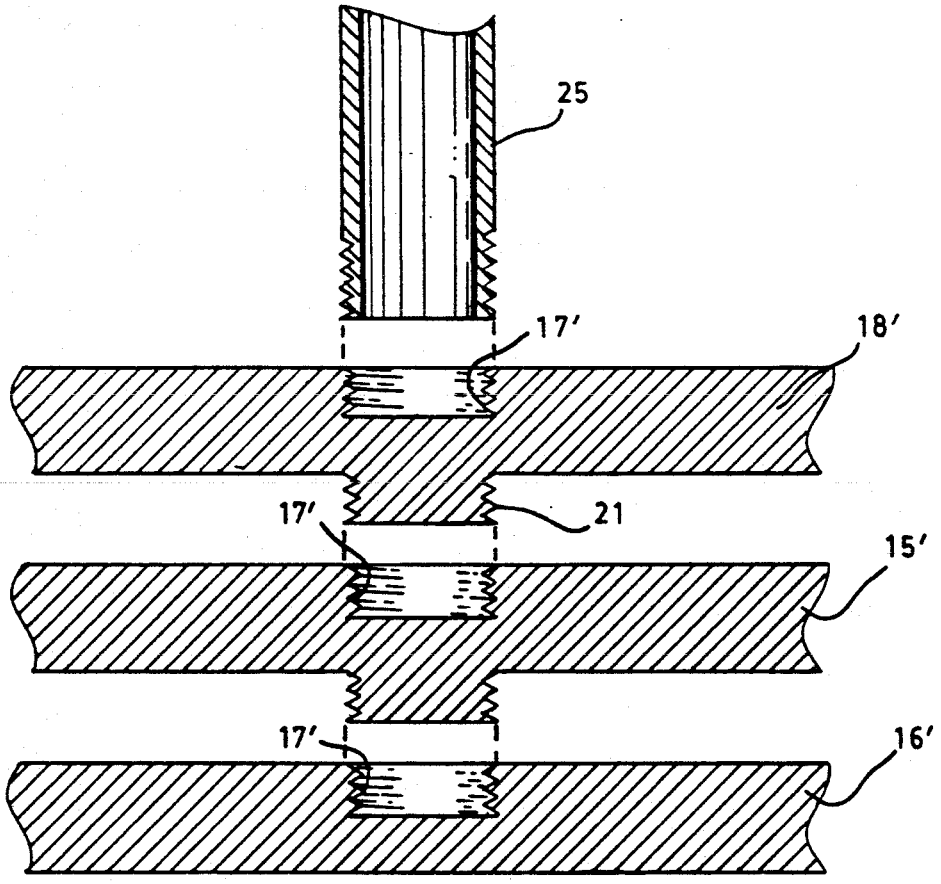
FIG. 7 illustrates a cross sectional view of an alternate embodiment of the readily adjustable recoil absorbing inertial mass of the device illustrated in FIG. 1.

Gripping means 50 is typically comprised of stationary jaw 52, gliding jaw 54, gripping pad members 58*a* and 58*b*, gripping width adjusting lever 60, threaded gripping width adjusting rod 62 and guide pins 55*a* and 55*b*. As gripping width adjusting lever 60 is rotated about the axis of threaded gripping width adjusting rod 62, the distance between gliding jaw 54 and stationary jaw 52 is increased or decreased depending upon the direction of rotation. As the distance is decreased, the gripping pad members 58*a* and 58*b* engage gun 12. Gripping pad members 58*a* and 58*b* as illustrated in FIG. 5 are constructed of a compressible material so as to prevent marring the finish of gun 12 and are carried by the opposing faces of jaws 54 and 52. It will be of course understood that, as illustrated in FIG. 6, gripping pad members 58*a*' and 58*b*' could be formed around jaws 54 and 52 by dipping jaws 54 and 52 in a hot compressible material such as, though not limited to, natural or synthetic rubber while such material is in a liquid state. Guide pins 55*a* and 55*b* prevent twisting of gliding jaw 54 due to torque. Those skilled in the art will recognize the necessity of taking care in choosing the amount of force to be exerted by gripping means 50 in order to prevent damaging gun 12.

Prior to using stand 10, the shooter would select the number of additional inertial mass members 18 or 18' needed depending upon the caliber of gun 12. The shooter would then interlock the inertial members and thread lower end of upright member 25 into threaded receptor 17 or 17'. Using height adjusting means 28, the shooter would selectively adjust the height of the stand. The shooter would loosen fine tuning stop 35 and then would pull height adjusting knob 31 thus disengaging height adjusting rod 30 from receptor 44. Telescoping shaft 40 could then be raised or lowered to the desired height. Spring 32 would reengage height adjusting rod 30 with receptor 44 when height adjusting knob 31 was released; fine tuning stop 35 could then be retightened.

The shooter would open gripping means 50 by rotating gripping width adjusting lever 60 about the axis of threaded gripping width adjusting rod 62 Gun 12 would be placed between gripping pads 58*a* and 58*b* and gripping means tightened taking care not to apply a force great enough to damage gun 12. At this point the gun would be ready to fire. It will be understood, of course, that gun 12 could be removed by reversing the above procedure.

From the foregoing description, it will be recognized by those skilled in the art that an improved gun stand offering advantages over the prior art has been provided. Specifically, the improved gun stand provides an improved gun stand with a readily changeable recoil absorbing inertial mass that also functions as a supportive base. The gun stand of the present invention provides a stand that allows the height of the stand to be readily adjusted and has gripping means that grip the stock of the gun that is to be fired or cleaned.

While a preferred embodiment has been shown and described, it will be understood that it is not intended to limit the disclosure, but rather it is intended to cover all modifications and alternate constructions falling within the spirit and the scope of the invention as defined in the appended claims.

Having thus described the aforementioned invention, I claim:

1. An improved gun stand for securing a gun wherein said gun stand is capable of absorbing recoil that results from firing said gun, wherein said gun stand comprises:

a base means for engaging a supporting surface for stabilizing and supporting said gun stand said base means including an inertial mass means for absorbing said recoil, said base means thereby allowing said stand to rest on said supporting surface and alleviating the necessity of attaching said stand to said supporting surface;

support means having a lower end attached to said base means and at least one upper end; and a gun clamping means attached to said at least one upper end of said support means whereby said gun clamping means secures said gun to said gun stand in a clamping fashion.

2. The improved gun stand of claim 1 wherein said inertial mass means is adjustable in mass.

3. The improved gun stand of claim 1 wherein said inertial mass means comprises a plurality of inertial mass members that are carried out by said support means thus stabilizing said gun stand during said recoil of said gun.

4. An improved gun stand for securing a gun wherein said gun is capable of absorbing recoil that results from firing said gun, wherein said gun stand comprises:

a base means for engaging a supporting surface for stabilizing and supporting said gun stand;

an inertial mass means carried by said gun stand for absorbing said recoil wherein said inertial mass means is adjustable in mass;

support means having a lower end attached to said base and at least one upper end; and a gun clamping means attached to said at least one upper end of said support means whereby said gun clamping means secures said gun to said gun stand in a clamping fashion.

5. The improved gun stand of claim 4 wherein said inertial mass means additionally functions as said base means thus allowing said stand to rest on said supporting surface and alleviating the necessity of attaching said stand to said supporting surface.

6. The improved gun stand of claim 5 wherein said inertial mass means comprises:

a first inertial mass member defining upper and lower surfaces wherein said first inertial mass member receives said lower end of said support means;

at least one additional inertial mass members defining upper and lower surfaces wherein said additional inertial mass member is provided with at least one hole defining member which slidably receives said support means; and means for releasably interlocking said first inertial mass member and said plurality of additional inertial mass members.

7. The improved gun stand of claim 6 wherein said attached inertial mass member is removably attached to said support means thereby allowing said support means to be removed from said attached inertial mass member such that the effective means for absorbing recoil can be adjusted.

8. The improved gun stand of claim 7 wherein said attached inertial mass member is removably attached to said support means by means of a threaded hole part which threadably receives said lower end of said support means.

9. The improved gun stand of claim 6 wherein said first and additional inertial mass members are stacked one upon the other such that said hole defining members are aligned thus allowing said support means to be received within said hole defining members of said inertial mass members.

10. The improved gun stand of claim 9 wherein said first and said additional inertial mass members define juxtaposed upper and lower surfaces, said upper and lower surfaces carrying registering male and female members, said female members functioning as receptors that receive said male members such that when said additional inertial mass member is stacked upon said first inertial mass member said male members and said female members cooperate thus releasably interlocking said inertial mass members.

11. The improved gun stand of claim 9 wherein said first and said additional inertial mass members define juxtaposed upper and lower surfaces, said upper and lower surfaces carrying a threaded member and a threaded receptor in register with and for threadably receiving said threaded member, such that when said additional inertial mass member is stacked upon said first inertial mass member said threaded member and said threaded receptor and cooperate thus threadably interlocking said inertial mass members.

12. An improved gun stand for securing a gun and capable of absorbing recoil that results from firing said gun, wherein said gun stand comprises:

a base means for engaging a supporting surface for stabilizing and supporting said gun stand;

an inertial mass means associated with said base means for absorbing said recoil;

inertial mass adjustment means for adjusting mass of said inertial mass means depending on the needs of an operator;

at least one elongated support member having a lower end attached to said base and at least one upper end; and a gun clamping means attached to said upper end of said elongated support member wherein said gun clamping means secures said gun in a clamping fashion.

13. An improved gun stand for securing a gun wherein said gun stand is capable of absorbing the recoil that results from firing said gun, wherein said gun stand comprises:

a base means for engaging a supporting surface for stabilizing and supporting said gun stand said base means including an inertial mass means for absorbing said recoil wherein said inertial mass means comprises a plurality of inertial mass members carried by said support means for stabilizing said gun stand during said recoil of said gun, said base means thereby allowing said gun stand to rest on said supporting surface and alleviating the necessity of attaching said stand to said supporting surface;

support means having a lower end attached to said base means and at least one upper end; and a gun clamping means attached to said at least one upper end of said support means whereby said gun clamping means secures said gun to said gun stand in a clamping fashion.

14. The improved gun stand of claim 13 wherein said gun stand further comprises inertial mass adjustment means for adjusting mass of said inertial mass means depending on the needs of an operator.

15. The improved gun stand of claim 13 wherein said elongated support member further comprises height adjusting means for adjusting the height of said stand.

16. An improved gun stand for securing a gun and capable of absorbing recoil that results from firing said gun, wherein said stand comprises:

a base which engages a supporting surface for stabilizing and supporting said stand;

an inertial mass means which absorbs the recoil that results when said gun is fired;

inertial mass adjustment means for adjusting the mass of said inertial mass means depending on the needs of an operator;

at least one elongated support member with a lower end attached to said base and at least one upper end;

height adjusting means attached to said elongated support member for adjusting the height of said stand to suit individual operators; and a gun clamping means attached to said upper end of said elongated support member wherein said gun clamping means secures said gun in a clamping fashion.

17. The improved gun stand of claim 16 wherein said gun clamping means comprises compressible padding means carried by said clamping means wherein said compressible padding means pads and protects said gun.

18. The height adjusting mans of claim 16 wherein said height adjusting means comprises:

a first elongated telescoping member which defines at least one hole;

a second elongated telescoping member received by said first elongated telescoping member which defines at least one hole for registering with said hole carried by said first elongated member; and an axially movable rod received by said holes when said holes are in register thereby releasably locking said stand at a selected height.

19. The height adjusting means of claim 18 wherein said rod is kept in cooperation with said holes by spring means.

20. The height adjusting means of claim 19 wherein said height adjusting means further comprises:

a spring housing carried by said first elongated telescoping member for containing said spring; and a spring stop carried by said rod such that said spring applies a force against said rod thereby keeping said rod in cooperation with said holes.

21. An improved gun stand for securing a gun wherein said gun stand is capable of absorbing the recoil that results from firing said gun for the purpose of reducing the rearward motion of said gun during said recoil thus maintaining the stationary position of said gun, wherein said gun stand comprises:

a base means for engaging a supporting surface for stabilizing and supporting said gun stand said base means including an inertial mass means for absorbing said recoil wherein said inertial mass means is adjustable in mass and wherein said inertial mass means comprises a plurality of inertial mass members carried by said support means thus stabilizing said gun stand during said recoil of said gun, said base means thereby allowing said stand to rest on said supporting surface and alleviating the necessity of attaching said stand to said supporting surface;

support means having a lower end attached to said base means and at least one upper end; and a gun clamping means attached to said at least one upper end of said support means whereby said gun clamping means secures said gun to said gun stand in a clamping fashion.

* * * * *